US011035198B2

(12) United States Patent
McAdam et al.

(10) Patent No.: US 11,035,198 B2
(45) Date of Patent: Jun. 15, 2021

(54) MULTIFUNCTION BLOWOUT PREVENTER

(71) Applicant: DRECO ENERGY SERVICES ULC, Calgary (CA)

(72) Inventors: David McAdam, Calgary (CA); Brian McAdam, Calgary (CA); James Orr, Sherwood Park (CA); Clark Weiss, Grand Prairie (CA)

(73) Assignee: DRECO ENERGY SERVICES ULC, Calgary (CA)

( * ) Notice: Subject to any disclaimer, the term of this patent is extended or adjusted under 35 U.S.C. 154(b) by 0 days.

(21) Appl. No.: 16/478,061

(22) PCT Filed: Jan. 12, 2018

(86) PCT No.: PCT/CA2018/050025
§ 371 (c)(1),
(2) Date: Jul. 15, 2019

(87) PCT Pub. No.: WO2018/129620
PCT Pub. Date: Jul. 19, 2018

(65) Prior Publication Data

US 2019/0360299 A1 Nov. 28, 2019

Related U.S. Application Data

(60) Provisional application No. 62/446,790, filed on Jan. 16, 2017.

(51) Int. Cl.
*E21B 34/02* (2006.01)
*E21B 33/06* (2006.01)

(52) U.S. Cl.
CPC ..... *E21B 34/02* (2013.01); *E21B 33/062* (2013.01)

(58) Field of Classification Search
CPC ..... E21B 34/02; E21B 33/06–024; E21B 43/121; E21B 43/12; Y10T 137/87917
See application file for complete search history.

(56) References Cited

U.S. PATENT DOCUMENTS 665,073 A 1/1901 Doyle et al.
958,862 A 5/1910 Durham
(Continued)

FOREIGN PATENT DOCUMENTS

CA 2153612 A1 1/1997
CA 2544718 A1 11/2006
(Continued)

OTHER PUBLICATIONS

"U.S. Appl. No. 15/742,632, Corrected Notice of Allowability dated Jan. 21, 2020", 2 pgs.
(Continued)

*Primary Examiner* — Aaron L Lembo
(74) *Attorney, Agent, or Firm* — Schwegman Lundberg & Woessner, P.A.

(57) ABSTRACT

A multifunction blowout preventer has a housing formed from a single piece of material, which has a central bore, a bottom connection, a gate valve section, an integrated ram assembly/flow tee section, and a top connection. The blowout preventer optionally includes a gas lift/electrical ports section. The components of the blowout preventer are radially offset and/or staggered from one another about the periphery of the housing to help minimize the height of the blowout preventer.

13 Claims, 12 Drawing Sheets

(56) References Cited

U.S. PATENT DOCUMENTS

| | | | | |
|---|---|---|---|---|
| 1,517,504 | A * | 12/1924 | Hansen | E21B 33/04 277/325 |
| 1,517,540 | A | 12/1924 | Dempsey | |
| 1,891,417 | A | 12/1932 | Heggem | |
| 2,059,798 | A | 11/1936 | Kniss | |
| 2,237,709 | A | 4/1941 | Lowe | |
| 2,258,887 | A | 10/1941 | Fortune | |
| 2,573,832 | A | 11/1951 | Harold | |
| 2,846,013 | A | 8/1958 | Davis | |
| 3,084,946 | A | 4/1963 | Sharp | |
| 3,149,514 | A | 9/1964 | Shaub | |
| 3,186,722 | A | 6/1965 | Johnston | |
| 3,195,645 | A | 7/1965 | Doyle | |
| 3,651,717 | A | 3/1972 | Johnston | |
| 3,716,245 | A | 2/1973 | Turolla | |
| 3,796,103 | A | 3/1974 | Winfield | |
| 3,830,304 | A | 8/1974 | Cummins | |
| 4,071,085 | A * | 1/1978 | Grable | E21B 33/06 166/84.4 |
| 4,153,111 | A | 5/1979 | Lans et al. | |
| 4,407,510 | A | 10/1983 | Cornelius et al. | |
| 4,560,176 | A | 12/1985 | Hoff | |
| 4,580,762 | A | 4/1986 | Hirtz et al. | |
| 4,583,569 | A | 4/1986 | Ahlstone | |
| 4,613,140 | A | 9/1986 | Knox | |
| 4,716,970 | A | 1/1988 | Henning | |
| 4,777,849 | A | 10/1988 | Sears | |
| 4,865,245 | A | 9/1989 | Schulte et al. | |
| 4,889,184 | A | 12/1989 | Lugtmeier et al. | |
| 4,951,743 | A | 8/1990 | Henderson | |
| 5,257,812 | A | 11/1993 | Osorio et al. | |
| 5,400,857 | A | 3/1995 | Whitby et al. | |
| 5,408,901 | A | 4/1995 | Bishop | |
| 5,636,688 | A | 6/1997 | Bassinger | |
| 5,641,019 | A | 6/1997 | Stout et al. | |
| 5,711,533 | A | 1/1998 | Angelo et al. | |
| 5,791,411 | A | 8/1998 | Ricalton et al. | |
| 5,865,245 | A | 2/1999 | Trout et al. | |
| 6,176,466 | B1 * | 1/2001 | Lam | E21B 33/06 137/613 |
| 7,216,872 | B1 | 5/2007 | Shaw et al. | |
| 8,544,535 | B2 * | 10/2013 | Cote | E21B 33/03 166/75.13 |
| 8,631,861 | B1 | 1/2014 | Busch | |
| 8,746,345 | B2 * | 6/2014 | Kotrla | E21B 33/064 166/344 |
| 8,899,338 | B2 * | 12/2014 | Elsayed | E21B 33/085 166/385 |
| 9,188,122 | B1 | 11/2015 | Reed | |
| 9,702,203 | B2 | 7/2017 | Bolstad, Jr. | |
| 10,597,968 | B2 | 3/2020 | McAdam et al. | |
| 10,900,313 | B2 | 1/2021 | McAdam et al. | |
| 10,920,887 | B2 | 2/2021 | McAdam et al. | |
| 2003/0070806 | A1 | 4/2003 | Connell et al. | |
| 2003/0221844 | A1 | 12/2003 | Dallas | |
| 2006/0081368 | A1 | 4/2006 | Rosine et al. | |
| 2006/0124314 | A1 | 6/2006 | Haheim et al. | |
| 2008/0078558 | A1 | 4/2008 | Dallas | |
| 2009/0056930 | A1 | 3/2009 | Angelle et al. | |
| 2009/0260834 | A1 | 10/2009 | Henson et al. | |
| 2011/0168405 | A1 | 7/2011 | Parlee | |
| 2011/0198072 | A1 | 8/2011 | Cote et al. | |
| 2011/0203670 | A1 | 8/2011 | Braddick | |
| 2011/0266005 | A1 | 11/2011 | Hult et al. | |
| 2011/0278515 | A1 | 11/2011 | Perio | |
| 2012/0012339 | A1 | 1/2012 | Weir et al. | |
| 2012/0012340 | A1 | 1/2012 | Ensley et al. | |
| 2012/0024521 | A1 | 2/2012 | Villa | |
| 2012/0305102 | A1 | 12/2012 | Kukielka | |
| 2013/0126157 | A1 | 5/2013 | Farrar | |
| 2013/0126763 | A1 | 5/2013 | Guo et al. | |
| 2013/0147121 | A1 | 6/2013 | Xu | |
| 2013/0180733 | A1 | 7/2013 | Bradshaw et al. | |
| 2013/0199773 | A1 | 8/2013 | Tebay | |
| 2013/0327528 | A1 | 12/2013 | Frost | |
| 2013/0341045 | A1 | 12/2013 | Flusche | |
| 2015/0047858 | A1 | 2/2015 | Varkey et al. | |
| 2015/0218903 | A1 | 8/2015 | Sellers, Jr. et al. | |
| 2015/0285013 | A1 | 10/2015 | Johnson et al. | |
| 2015/0300106 | A1 | 10/2015 | Martin et al. | |
| 2016/0251917 | A1 | 9/2016 | Harrell et al. | |
| 2017/0146007 | A1 | 5/2017 | Robison et al. | |
| 2017/0306745 | A1 | 10/2017 | Harding et al. | |
| 2018/0202254 | A1 | 7/2018 | Mcadam et al. | |
| 2019/0040696 | A1 | 2/2019 | Mcadam et al. | |
| 2019/0049017 | A1 | 2/2019 | Mcadam et al. | |
| 2019/0093441 | A1 | 3/2019 | Mcadam et al. | |
| 2019/0234167 | A1 | 8/2019 | Mcadam et al. | |
| 2020/0298385 | A1 | 9/2020 | Mcadam et al. | |

FOREIGN PATENT DOCUMENTS

| | | | |
|---|---|---|---|
| CA | 2509182 | A1 | 12/2006 |
| CA | 2942857 | A1 | 10/2015 |
| CA | 2991538 | A1 | 1/2017 |
| CA | 3013084 | A1 | 8/2017 |
| CN | 2567336 | Y | 8/2003 |
| CN | 202090881 | U | 12/2011 |
| CN | 202731817 | U | 2/2013 |
| GB | 2206932 | A | 1/1989 |
| WO | WO-2017004696 | A1 | 1/2017 |
| WO | WO-2018018142 | A1 | 2/2018 |
| WO | WO-2018049503 | A1 | 3/2018 |
| WO | WO-2018129620 | A1 | 7/2018 |
| WO | WO-2018213918 | A1 | 11/2018 |
| WO | WO-2019056088 | A1 | 3/2019 |

OTHER PUBLICATIONS

"U.S. Appl. No. 15/742,632, Non Final Office Action dated Jun. 26, 2019", 13 pgs.

"U.S. Appl. No. 15/742,632, Notice of Allowance dated Nov. 14, 2019"' 5 5 pgs.

"U.S. Appl. No. 15/742,632, Preliminary Amendment filed Jan. 8, 2018", 3 pgs.

"U.S. Appl. No. 15/742,632, Response filed Oct. 28, 2019 to Non-Final Office Action dated Jun. 26, 2019", 9 pgs.

"U.S. Appl. No. 15/989,877, Examiner Interview Summary dated Aug. 18, 2020", 3 pgs.

"U.S. Appl. No. 15/989,877, Final Office Action dated Jun. 1, 2020", 18 pgs.

"U.S. Appl. No. 15/989,877, Non Final Office Action dated Oct. 1, 2020", 19 pgs.

"U.S. Appl. No. 15/989,877, Non Final Office Action dated Dec. 6, 2019", 17 pgs.

"U.S. Appl. No. 15/989,877, Response filed Mar. 6, 2020 to Non Final Office Action dated Dec. 6, 2019", 9 pgs.

"U.S. Appl. No. 15/989,877, Response filed Sep. 1, 2020 to Final Office Action dated Jun. 1, 2020".

"U.S. Appl. No. 16/076,574, Examiner Interview Summary dated Jun. 12, 2020", 3 pgs.

"U.S. Appl. No. 16/076,574, Non Final Office Action dated Apr. 2, 2020", 7 pgs.

"U.S. Appl. No. 16/076,574, Notice of Allowance dated Oct. 15, 2020", 7 pgs.

"U.S. Appl. No. 16/076,574, Response filed Jul. 2, 2020 to Non Final Office Action dated Apr. 2, 2020", 10 pgs.

"U.S. Appl. No. 16/139,690, Non Final Office Action dated May 13, 2020", 13 pgs.

"U.S. Appl. No. 16/139,690, Notice of Allowance dated Nov. 4, 2020", 11 pgs.

"U.S. Appl. No. 16/139,690, Response filed Aug. 10, 2020 to Non Final Office Action dated May 13, 2020", 11 pgs.

"U.S. Appl. No. 16/316,661, Notice of Allowance dated Jun. 17, 2020", 9 pgs.

"U.S. Appl. No. 16/316,661, Notice of Allowance dated Sep. 17, 2020", 8 pgs.

(56) References Cited

OTHER PUBLICATIONS

"U.S. Appl. No. 16/316,661, Preliminary Amendment filed Jan. 10, 2019", 5 pgs.
"U.S. Appl. No. 16/316,661, Supplemental Notice of Allowability dated Sep. 30, 2020", 2 pgs.
"International Application Serial No. PCT/CA2016/050373, International Preliminary Report on Patentability dated Jan. 18, 2018", 6 pgs.
"International Application Serial No. PCT/CA2016/050373, Written Opinion dated May 30, 2016", 4 pgs.
"International Application Serial No. PCT/CA2016/051532, International Preliminary Report on Patentability dated Mar. 28, 2019", 7 pgs.
"International Application Serial No. PCT/CA2016/051532, International Search Report dated Jan. 23, 2017", 3 pgs.
"International Application Serial No. PCT/CA2016/051532, Written Opinion dated Jan. 23, 2017", 4 pgs.
"International Application Serial No. PCT/CA2017/050161, International Preliminary Report on Patentability dated Aug. 14, 2018", 5 pgs.
"International Application Serial No. PCT/CA2017/050161, International Search Report dated Apr. 24, 2017", 3 pgs.
"International Application Serial No. PCT/CA2017/050161, Written Opinion dated Apr. 24, 2017", 4 pgs.
"International Application Serial No. PCT/CA2017/050890, International Preliminary Report on Patentability dated Feb. 7, 2019", 7 pgs.
"International Application Serial No. PCT/CA2017/050890, International Search Report dated Oct. 17, 2017", 3 pgs.
"International Application Serial No. PCT/CA2017/050890, Written Opinion dated Oct. 17, 2017", 4 pgs.
"International Application Serial No. PCT/CA2017/050963, International Search Report dated Nov. 8, 2017", 3 pgs.
"International Application Serial No. PCT/CA2017/050963, Written Opinion dated Nov. 8, 2017", 5 pgs.
"International Application Serial No. PCT/CA2018/000101, International Preliminary Report on Patentability dated Dec. 5, 2019", 6 pgs.
"International Application Serial No. PCT/CA2018/000101, International Search Report dated Oct. 26, 2018", 4 pgs.
"International Application Serial No. PCT/CA2018/000101, Written Opinion dated Oct. 26, 2018", 4 pgs.
"International Application Serial No. PCT/CA2018/000179, International Preliminary Report on Patentability dated Dec. 12, 2019", 8 pgs.
"International Application Serial No. PCT/CA2018/000179, International Search Report dated Dec. 21, 2018", 3 pgs.
"International Application Serial No. PCT/CA2018/000179, Response filed Jul. 25, 2019 to Written Opinion dated Dec. 21, 2018", 5 pgs.
"International Application Serial No. PCT/CA2018/000179, Written Opinion dated Dec. 21, 2018", 4 pgs.
"KH2030 20mm Ball Bushing 20x28x30 Linear Motion Bearing", VXB.com Bearings, [Online]. Retrieved from the Internet: <URL: http://www.vxb.com/KH2030-20mm-Ball-Bushing-20x28x30-Linear-Motion-p/Kit7140.htm?gclid=EAIaIQobChMisda3qpOc2wIVAtvACh1MlwBVEAYYBSABEgK7HvD_BwE, (Accessed May 14, 2020), 7 pgs.
"Pro Align (Opal)", Bell Industries A Division of Bell Envirotech Inc., [Online]. Retrieved from the Internet: <URL: http://www.bellindustries.ca/index.php/gallery1/harbison-fiseher/pro-align>, (2020), 2 pgs.
"Pro Align (Opal)", Harbison-Fischer Well Head Tools, (2020), 1 pg.
"Rod String", Dynatec International Ltd., [Online]. Removed from the Internet: <URL: https://protect-us.mimecast.com/s/0F_HC9rOL0HkW2oNHODTVr?domain=nelgarservices.com>, (2012), 1 pg.
"Rod-Knuckle Environmental Bob Stuffing Box", Nelgar Services Inc., [Online]. Retrieved from the Internet: <URL: https://protect-us.mimecast.com/s/0F_HC9rOL0HkW2oNHODTVr?domain=nelgarservices.com>, (2017), 4 pgs.
"Rod-Pump Accessories", Apergy Artificial Lift Technologies, [Online]. Retrieved from the Internet: <URL: https://apergyals.com/products/rod-lift/harbison-fischer/rod-pump-accessories/>, (2020), 11 pgs.
"The Weekly Screw", The Virtual Corkscrew Museum's Weekly Newspaper No. 469, [Online]. [Accessed Nov. 8, 2018]. Retrieved from the Internet: <URL: http://www.bullworks.net/daily/20070722.htm>, (Jul. 22, 2007), 14 pgs.
"Wellhead Accessories", Apergy Artificial Lift Technologies, [Online]. Retrieved from the Internet: <URL: https://apergyals.com/products/rod-lift/harbison-fischer/wellhead-accessories>, (2020), 7 pgs.
U.S. Appl. No. 16/316,661, filed Jan. 10, 2019, Method and Apparatus for Production Well Pressure Containment for Blowout.
U.S. Appl. No. 15/989,877, filed May 25, 2018, Method and Apparatus for Rod Alignment.
U.S. Appl. No. 16/076,574, filed Aug. 8, 2018, Anti-Extrusion Seal Arrangement and Ram-Style Blowout Preventer.
U.S. Appl. No. 16/139,690, filed Sep. 24, 2018, Adjustment Blowout Preventer and Methods of Use.
U.S. Appl. No. 15/742,632, filed Jan. 8, 2018, Modified Stuffing Box.
U.S. Appl. No. 16/358,069, filed Mar. 19, 2019, Packing Material Compaction and Extraction Tool.
"International Application Serial No. PCT/CA2018/050025, International Search Report dated Apr. 4, 2018", 3 pgs.
International Application Serial No. PCT/CA2018/050025, Written Opinion dated Apr. 4, 2018, 4 pgs.
"U.S. Appl. No. 15/989,877, Examiner Interview Summary dated Dec. 17, 2020", 3 pgs.
"U.S. Appl. No. 15/989,877, Response filed Dec. 31, 2020 to Non Final Office Action dated Oct. 1, 2020", 9 pgs.
"U.S. Appl. No. 15/989,877, Examiner Interview Summary dated Jan. 7, 2021", 3 pgs.

* cited by examiner

MULTIFUNCTION BLOWOUT PREVENTER

PRIORITY APPLICATIONS

The present application is a U.S. National Stage Filing under 35 U.S.C. 371 from International Application No. PCT/CA2018/050025, filed Jan. 12, 2018, which claims priority from U.S. Provisional Application No. 62/446,790 filed Jan. 16, 2017. Each of which are incorporated by reference herein by in their entirety.

FIELD

Embodiments herein relate generally to wellhead control for oil and/or gas production. More specifically, a low height blowout preventer capable of accommodating free flowing and artificial lift flow techniques is provided.

BACKGROUND

A variety of techniques can be used to produce oil and gas from wells. For flowing wells, the formation pressure is sufficient to produce oil and/or gas without requiring a pump, and a flow tee can be installed on the wellhead stack to direct the wellbore fluids naturally flowing out of the well. A gate valve can be installed below the flow tee to control the production of fluids. Reservoirs may initially be at pressures sufficient for oil and gas to flow to surface naturally, but can then lose pressure over time such that a well is no longer naturally flowing. In this situation, the wellhead stack must then be retrofitted to introduce artificial lift in the wellbore in order to continue or improve production.

Retrofitting a formerly flowing well for artificial lift production can be a labour intensive and costly process, involving the installation of pumping equipment and safety apparatuses, as well as the removal or replacement of existing equipment to accommodate the chosen artificial lift method. Should the chosen method of artificial lift change, another retrofit may be required in order to accommodate the new method. A well can undergo several changes in production methods over the course of its life.

Adding equipment to the wellhead stack may increase the height of the stack significantly, which negatively impacts wellhead stability. A higher wellhead stack may also necessitate elevating the service rig, or utilizing a more expensive pump jack. Installing new equipment also introduces additional connections between the various components, consequently increasing the number of potential leak points for wellbore fluids. Adding or replacing components at the wellhead will also often lead to changes in flow lines used to transport the produced wellbore fluid away from the well. Changes in the flow line could also necessitate changes in pipe supports and associated instrumentation.

Additionally, disassembling and re-assembling a wellhead stack can cause wear at the connection points between components. For example, components that use threadable engagements are at risk having their threads damaged during each assembly or break up of the wellhead stack. If the thread in a component is damaged, then the entire component must be discarded and replaced. The threads and sealing surfaces in such components also wear out each time the components are assembled and disassembled, allowing for about two to four assembly/break ups before the components are no longer safe to use. Using components with flanged connections reduces the risk of damaging sealing components, but such components are time-consuming to assemble and disassemble due to the numerous bolts that must be secured to strict torque specifications.

There is still a need for wellhead components which mitigate the need to remove, introduce, or replace components when a change in production method is desired, reduce the overall height of the wellhead stack, and lessen the risk of damaging the components during assembly and break up.

SUMMARY

According to a broad aspect of the present disclosure, there is provided a multifunction blowout preventer comprising: a housing formed as a single piece of material and having defined therein a longitudinal bore extending axially therethrough, the housing comprising: a bottom connection for connecting to a wellbore; a gate valve section having defined therein at least one cavity in communication with the bore, each of the at least one cavity for receiving a gate valve for controlling fluid flow through the bore; an integrated ram assembly/flow tee section having defined there: at least two pairs of opposing radial bores for receiving a sealing ram assembly; at least two pairs of opposing radial locking bores for receiving a rod lock ram assembly; and one or more flow bores for removing fluid from the wellbore and/or introducing fluid to the wellbore, wherein the at least two pairs of opposing radial bores, the at least two pairs of opposing radial locking bores, and the one or more flow bores extend radially outwardly from the bore and open to an exterior wall of the housing and are in communication with the bore, and the one or more flow bores are located axially in the housing between one or both of the two pairs of opposing radial bores and the two pairs of opposing radial locking bores that are closest to the bottom connection; and a top connection for connecting to upper wellhead components.

According to another broad aspect of the present disclosure, there is provided a multifunction blowout preventer comprising: a housing formed as a single piece of material and having defined therein a longitudinal bore extending axially therethrough, the housing comprising: a bottom connection for connecting to a wellbore; a gas lift/electrical ports section having defined therein one or both of: a gas lift bore extending between and opening to a gas lift port on an exterior wall of the housing and the face of the bottom connection; and one or more electrical ports extending between and opening to the exterior wall and the face; a gate valve section having defined therein at least one cavity in communication with the bore, each of the at least one cavity for receiving a gate valve for controlling fluid flow through the bore; an integrated ram assembly/flow tee section having defined there: at least one pair of opposing radial bores for receiving a sealing ram assembly; at least one pair of opposing radial locking bores for receiving a rod lock ram assembly; and one or more flow bores for removing fluid from the wellbore and/or introducing fluid to the wellbore, wherein the at least one pair of opposing radial bores, the at least one pair of opposing radial locking bores, and the one or more flow bores extend radially outwardly from the bore and open to the exterior wall and are in communication with the bore; and a top connection for connecting to upper wellhead components.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

DESCRIPTION

Figure 1A:
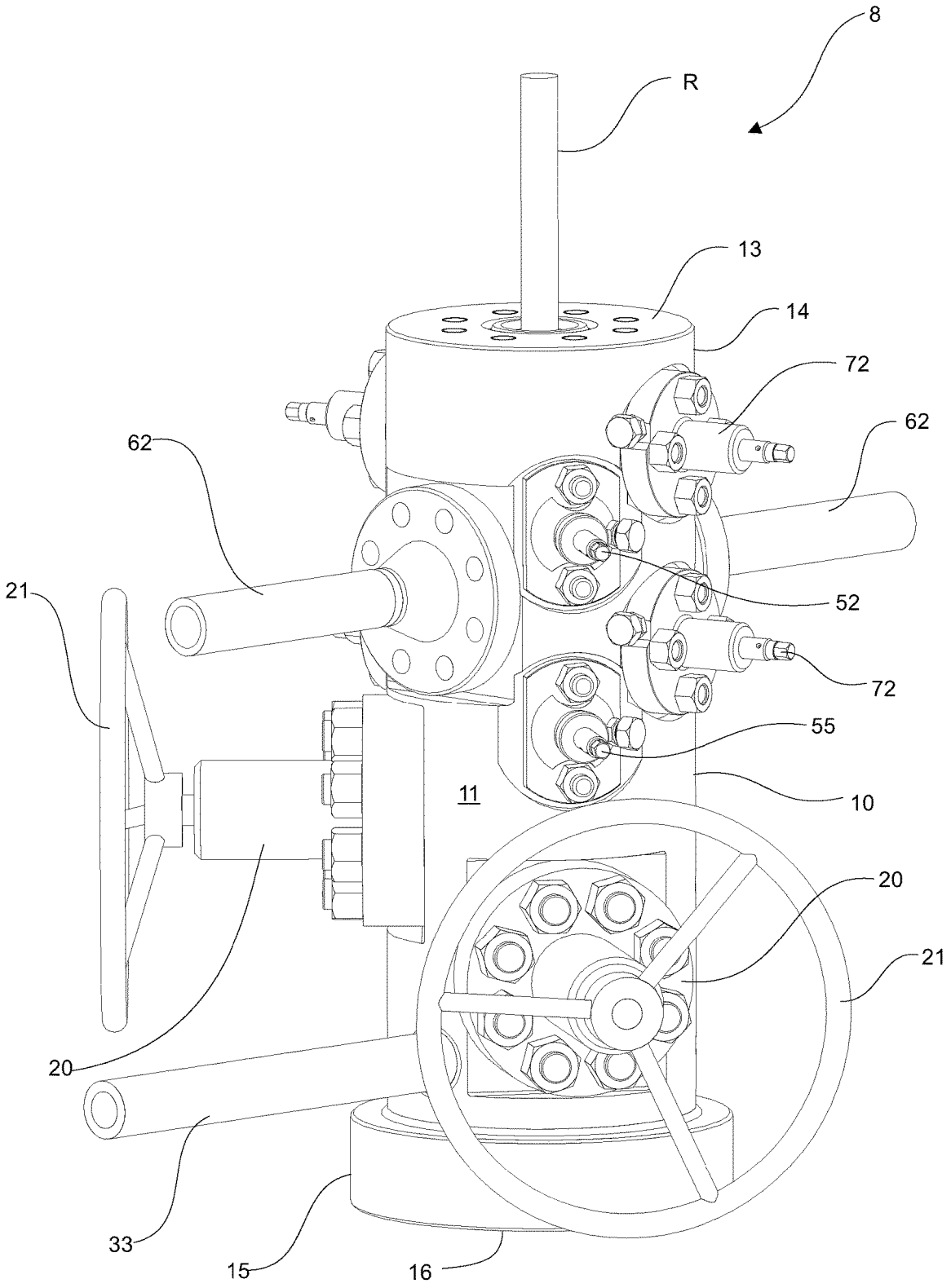
FIG. 1A is a first perspective view of a multifunction blowout preventer according to one embodiment of the present disclosure.
Figure 1B:
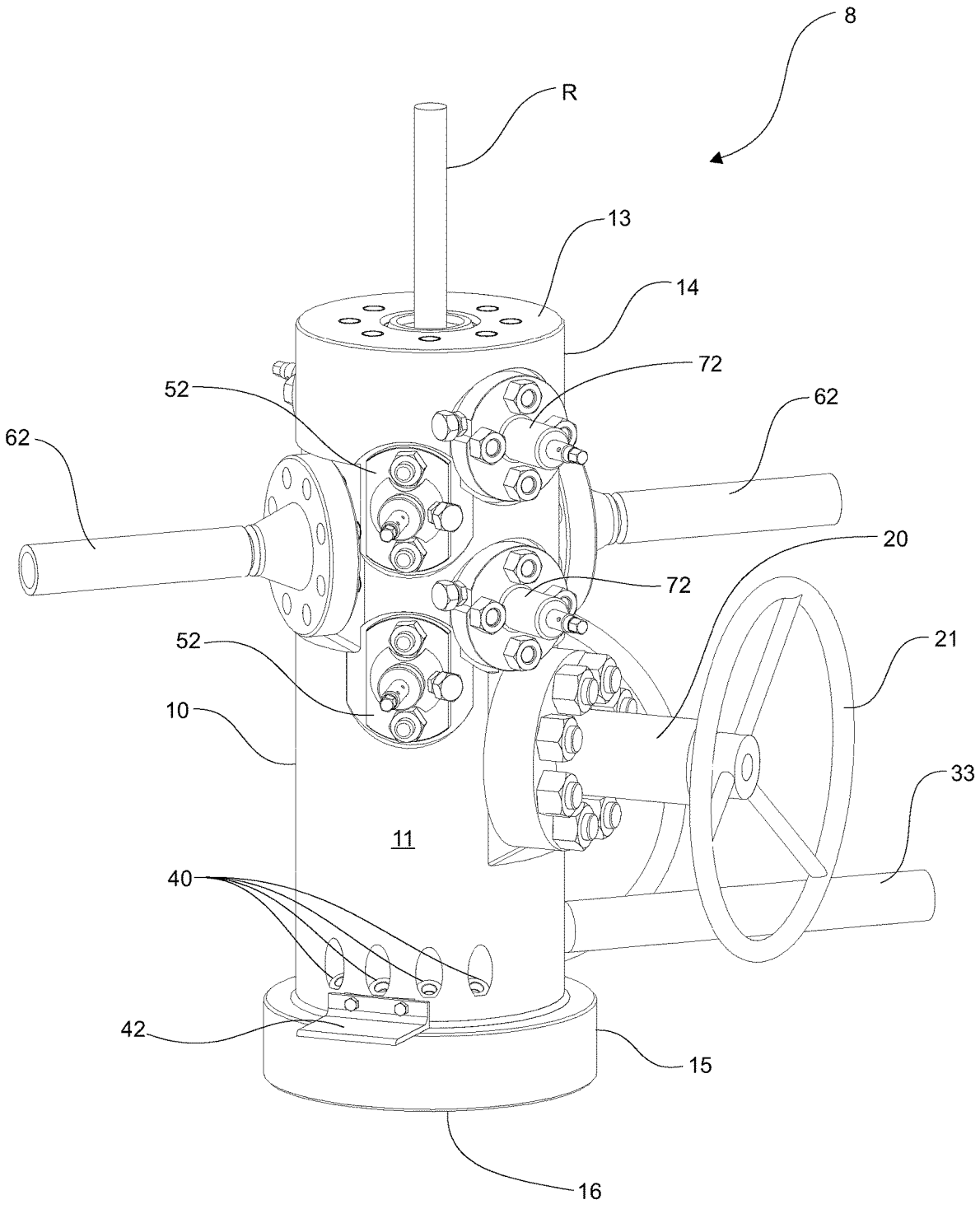
FIG. 1B is a second perspective view of the multifunction blowout preventer.
Figure 2:
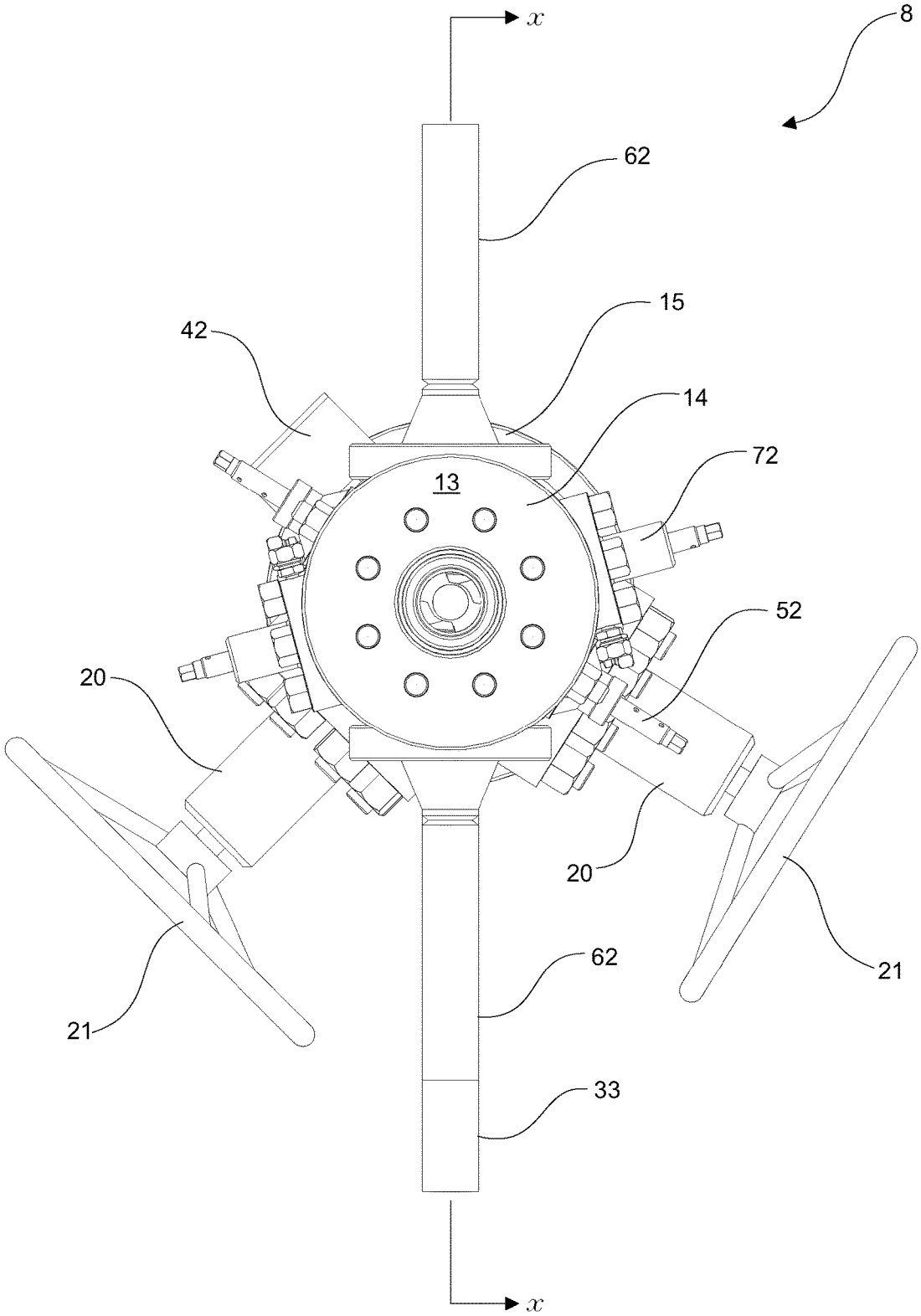
FIG. 2 is a top view of the multifunction blowout preventer.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

FIGS. 1A, 1B, 2, 3, 4A, and 4B show an embodiment of a multifunction blowout preventer (BOP) 8 which is a monolithic, integrated structural block of suitable material for oil and gas operation at service pressures. The BOP 8 comprises a main housing 10, having a longitudinal bore 12 extending therethrough for receiving a pump rod, such as a polished rod R. The housing 10 is made of a single piece of material. The housing 10 has a top connection 14 and a bottom connection 15.

Top connection 14 is for sealingly connecting to upper wellhead components (not shown), such as a stuffing box. The top connection 14 is shown, for example in FIG. 3, as a connection having a plurality of internally threaded holes opening at its face 13 for receiving a plurality of studs therein for connection to the stuffing box. However, the top connection 14 can be a flanged connection, clamp-hub connection, or rotatable flange connection as well.

Figure 3:
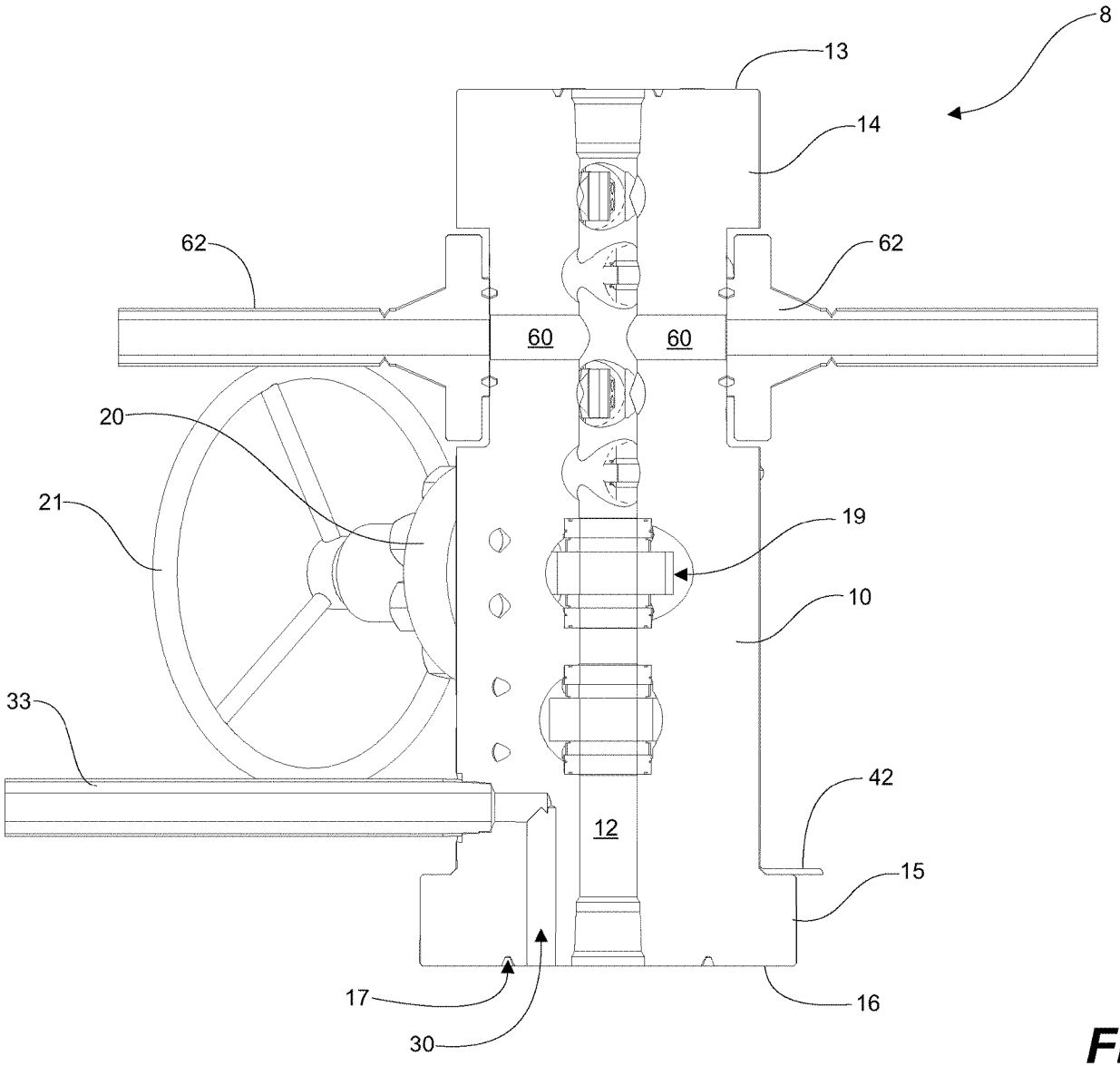
FIG. 3 is a cross-sectional perspective view of the multifunction blowout preventer of FIG. 2, along line x-x, showing a gas lift port and flow bores (and rod R is omitted)

The bottom connection 15 is for sealingly connecting to a wellbore (not shown). The bottom connection 15 is shown, for example in FIG. 3, as a connection having a plurality of internally threaded holes opening at its face 16 for receiving studs therein for connection to the wellbore. However, the bottom connection 15 can be a flanged connection, clamp-hub connection, or rotatable flange connection as well. As best shown in FIG. 3, a seal ring groove 17 is defined in the face 16 of the bottom connection 15 and the seal ring groove 17 extends around the bore 12, so that when a seal ring (not shown) is inserted therein and the bottom connection 15 is tightened against the wellbore, a fluid tight seal is obtained.

Referring now to FIGS. 3, 4B, 5A, 6A, 6B, 7A, and 7B, the BOP 8 has a gas lift/electrical ports section in the housing 10 near the bottom connection 15. The gas lift/electrical ports section includes a gas lift bore 30 defined in housing 10, extending between and opening to a gas lift port 32 on the exterior wall 11 of housing 10 and the face 16 of bottom connection 15, to allow fluid communication between the annulus, defined between the central wellbore tubing and the casing, and the exterior wall 11. The gas lift port 32 may have a gas lift tubing 33 extending outwardly therefrom. Gas lift bore 30 allows for the use of gas injection artificial lift methods, such as injecting high pressure gas into the annulus via port 32 and bore 30 to create a differential pressure in the wellbore, thereby mobilizing and urging wellbore fluids to flow up the central wellbore tubing. Gas lift bore 30 can also allow wellbore fluids to be produced therethrough, such as with jet pump methods wherein fluid is injected down the central wellbore tubing, and wellbore fluids are produced up the annulus through the gas lift bore 30 and gas lift port 32.

The gas lift/electrical ports section also includes one or more electrical ports 40 defined in housing 10. Each electrical port 40 extends between and opens to the exterior wall 11 and a location on the bottom face 16 for communication with the annulus between the central wellbore tubing and the casing. Electrical ports 40 are sized to accommodate wiring for an electrical submersible pump (ESP) from outside the BOP 8 to the annulus while maintaining a seal to contain wellbore pressure. Ports 40 are also provided for communication and control capability to monitor the ESP or other downhole equipment through fiber optic cables, pressurized capillary tubing, or other such communication systems. Sealing threads can be provided at both ends of ports 40 for forming a seal with the wiring components of the ESP. A mounting bracket 42 can also be provided on housing 10 for mounting an electrical junction box of the ESP thereon.

Figure 4A:
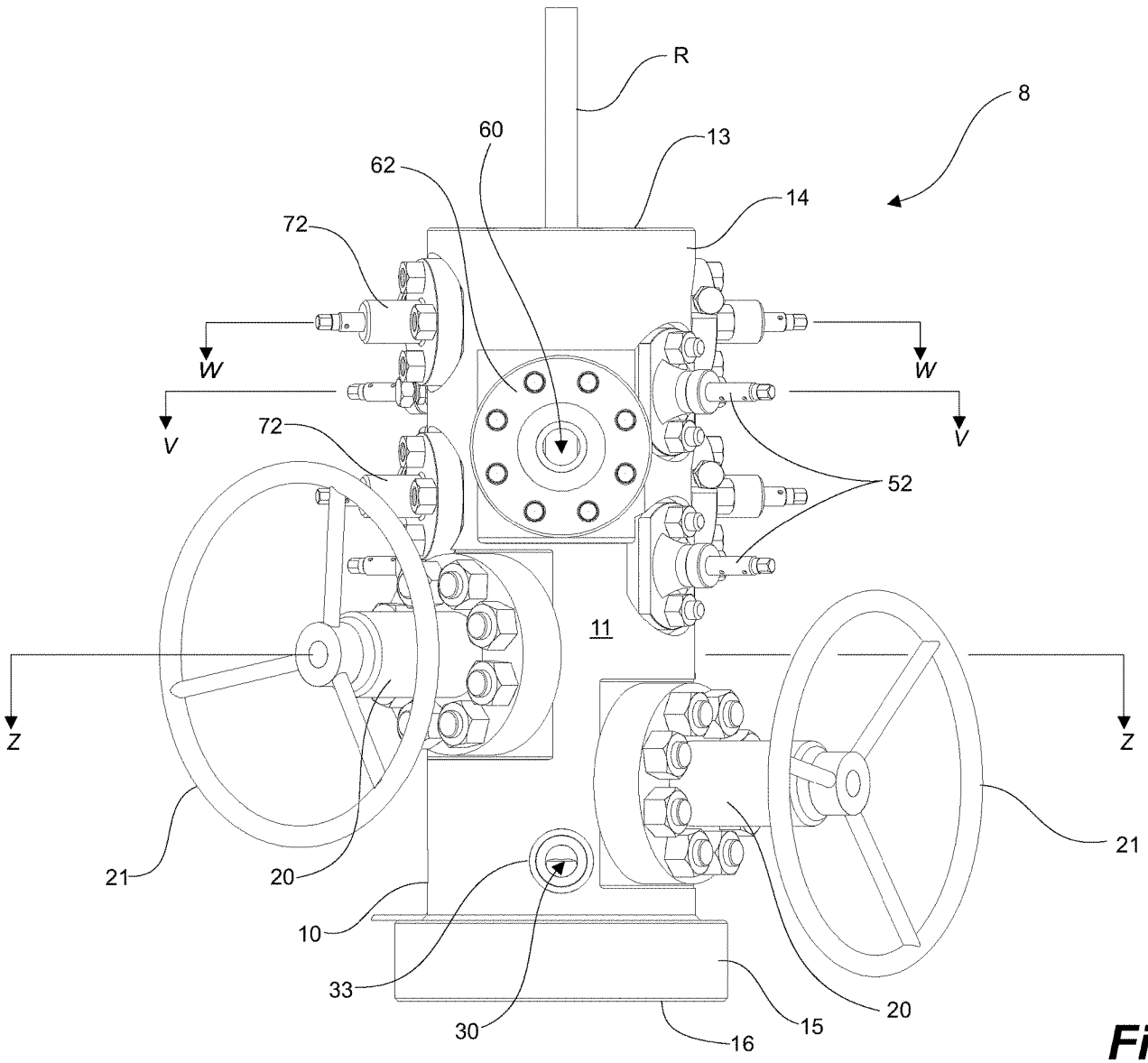
FIG. 4A is a first side view of the multifunction blowout preventer.
Figure 4B:
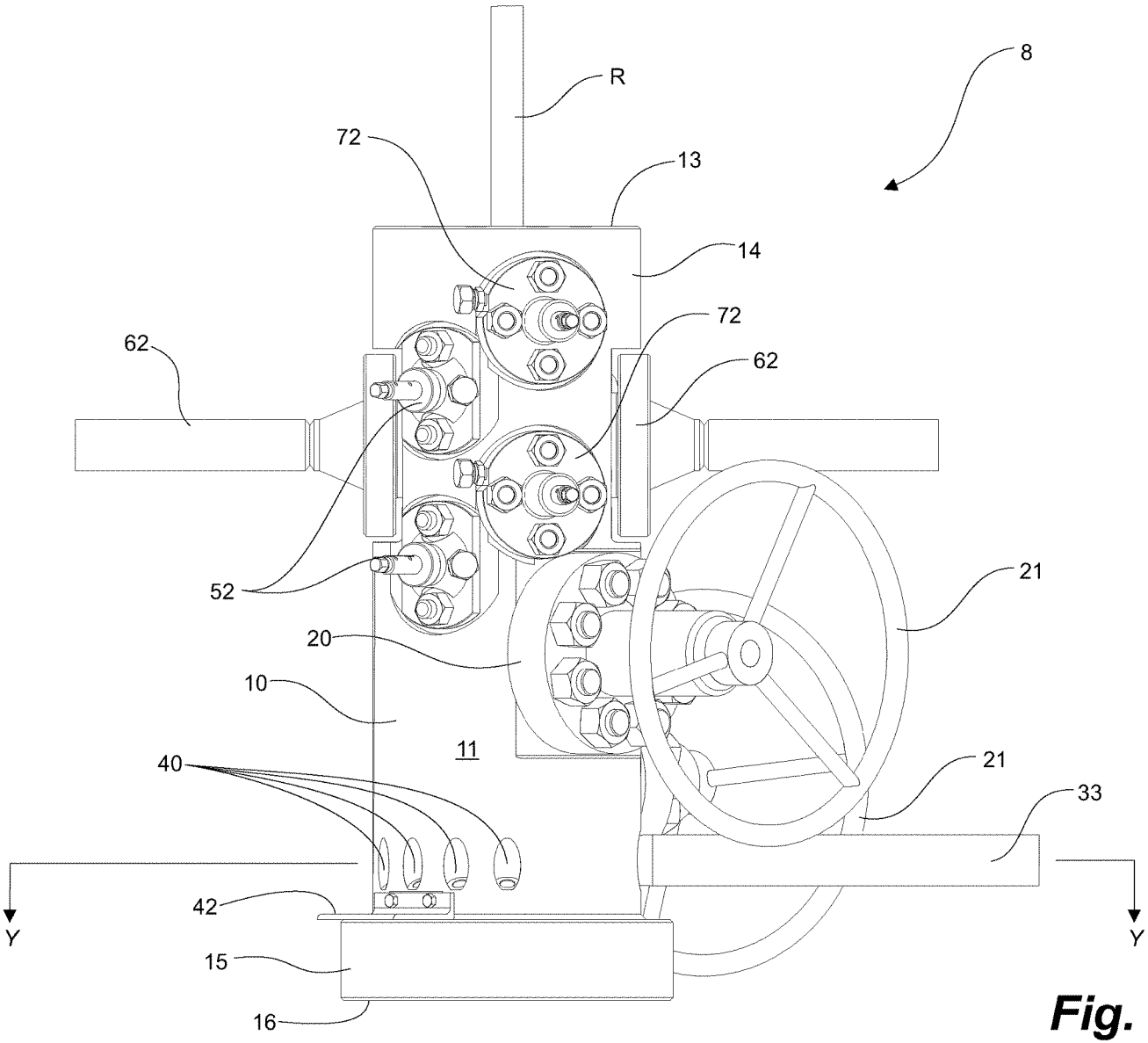
FIG. 4B is a second side view of the multifunction blowout preventer.
Figure 5A:
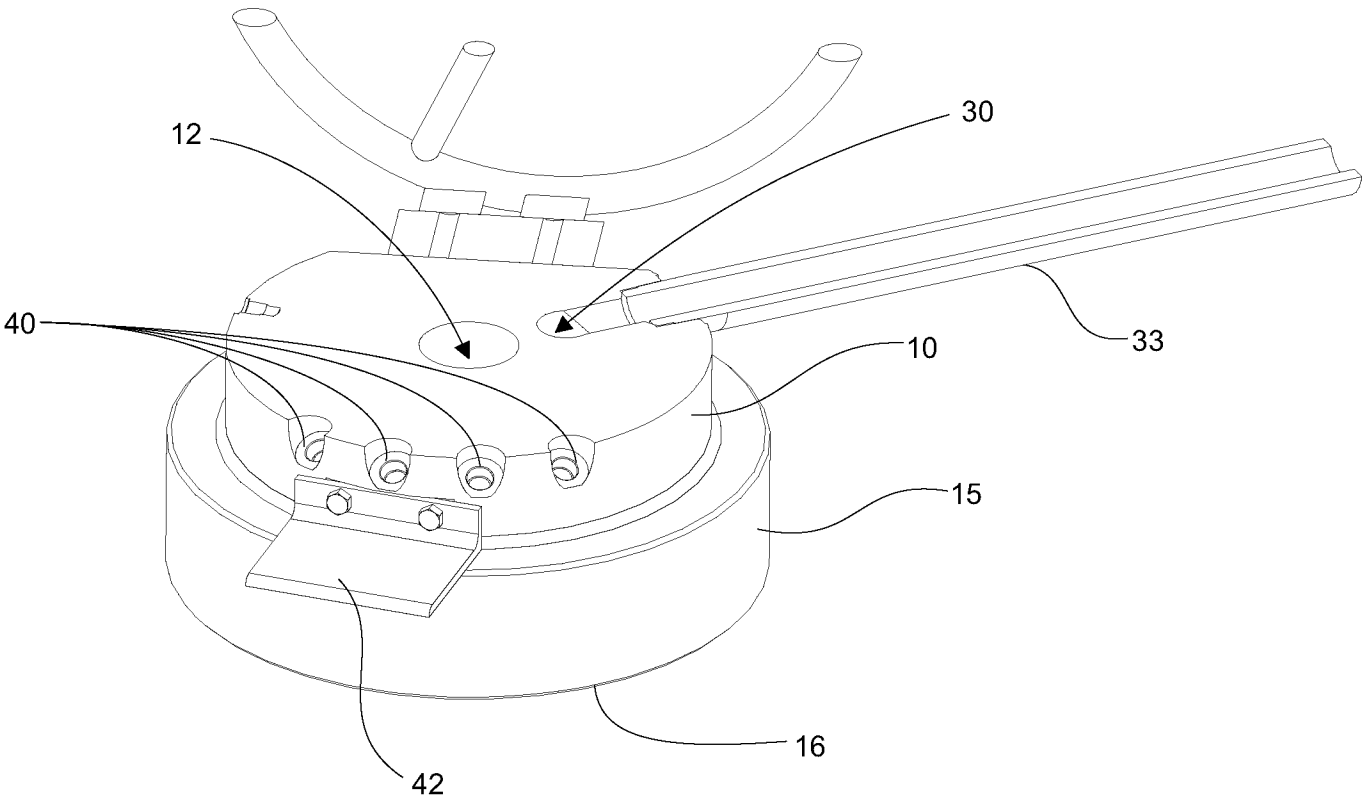
FIG. 5A is a cross-sectional perspective view of the multifunction blowout preventer of FIG. 4B, along line y-y, showing the gas lift port and electrical ports (and rod R is omitted)
Figure 5B:
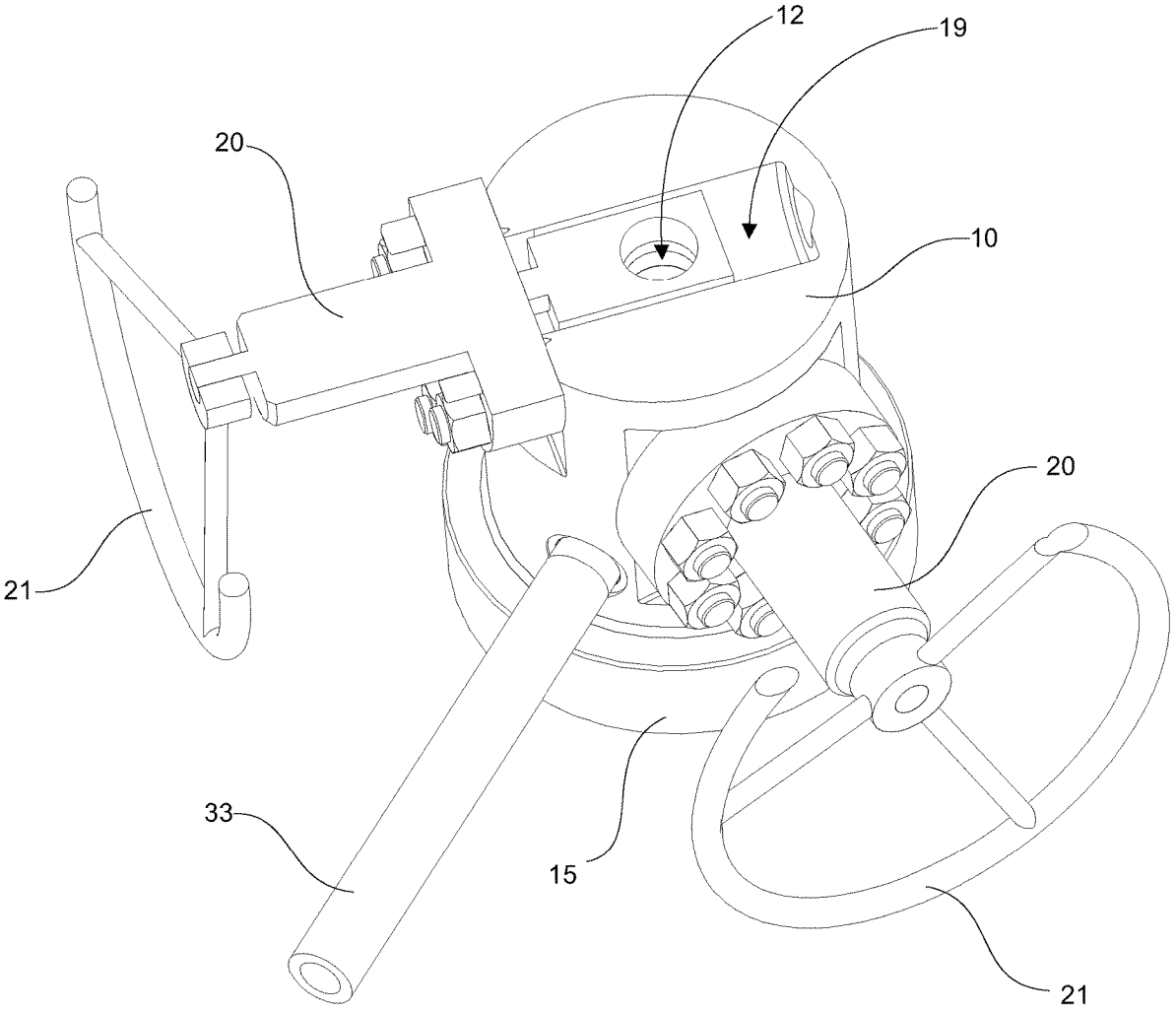
FIG. 5B is a cross-sectional perspective view of the multifunction blowout preventer of FIG. 4A, along line z-z, showing a gate valve (and rod R is omitted)

Referring to FIGS. 4A and 5B, the BOP 8 has a gate valve section located in housing 10 adjacent the gas lift/electrical ports section. The gate valve section has at least one cavity 19 in communication with bore 12. Each cavity 19 accommodates a gate valve 20 configured to actuate between an open position to allow fluids and other objects to flow therethrough, and a closed position to prevent fluid communication and other objects from flowing therethrough. Gate valve 20 functions as a master valve to control fluid flow through bore 12, for isolating the components of the BOP 8 above the gate valve 20 from wellbore pressure as required. The hand wheel and bonnet assembly 21 of gate valve 20 protrude externally of housing 10. While the gate valve section in the illustrated embodiment shown in FIG. 4A has two gate valves 20, the BOP 8 may have more or fewer gate valves in other embodiments. In some embodiments, gate valve 20 is rated at about 5000 psi, but in other embodiments, gate valve 20 can be rated higher or lower than about 5000 psi depending on the wellbore environment and pressures of the specific well.

Above the gate valve section, as shown in FIGS. 6A, 6B, 7A, and 7B, the BOP 8 has an integrated ram assembly/flow tee section in housing 10. At least one pair of opposing radial bores 50, at least one pair of opposing radial locking bores 70, and one or more flow bores 60 are defined in the integrated ram assembly/flow tee section. Bores 50, locking bores 70, and flow bores 60 each extend radially outwardly from bore 12 and open to the exterior wall 11, and are each in communication with bore 12. In some embodiments, each pair of bores 50 and locking bores 70 intersect bore 12 at a different axial location thereof. Flow bores 60 also intersect bore 12 at a different axial location than those of bores 50 and locking bores 70. In the illustrated embodiment, as shown in FIGS. 6A, 6B, 7A, and 7B, the BOP 8 has two pairs of radial bores 50 and two pairs of radial locking bores 70, and flow bores 60 intersect bore 12 at an axial location between the two pairs of bores 50 and the two pairs of locking bores 70. While two pairs of bores 50, 70 are shown in the illustrated embodiment, more or fewer pairs of bores 50, 70 may be included other embodiments of the BOP 8, and flow bore 60 can be located between any adjacent pairs of bores 50 and/or bores 70. Furthermore, while the flow bores 60 are shown in the illustrated embodiment to be located above the lowermost pair of bores 50 and locking bores 70, the flow bores 60 may be located elsewhere axially in other embodiments.

Figure 5C:
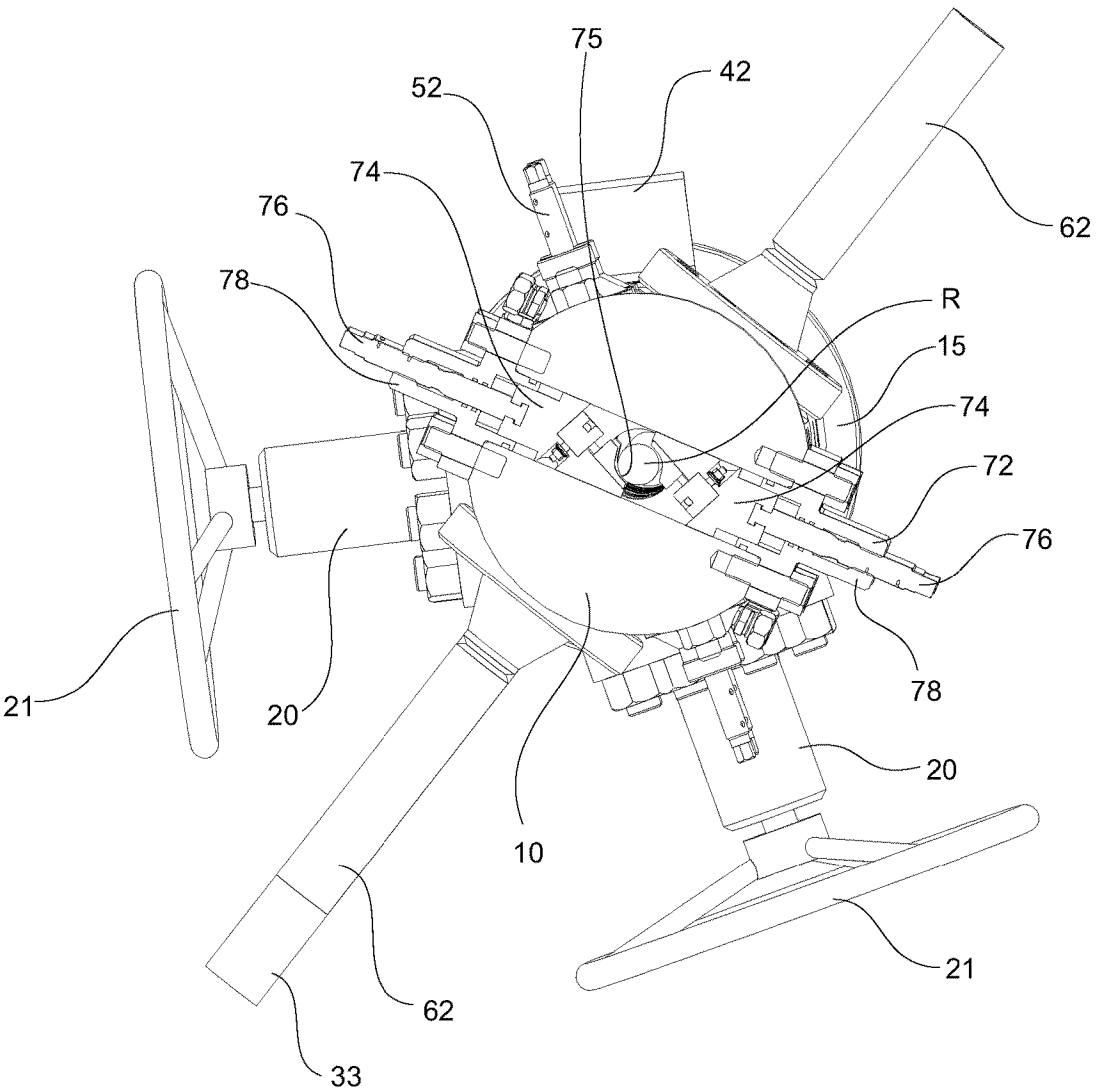
FIG. 5C is a cross-sectional perspective view of the multifunction blowout preventer of FIG. 4A, along line w-w, showing a rod lock ram assembly.
Figure 5D:
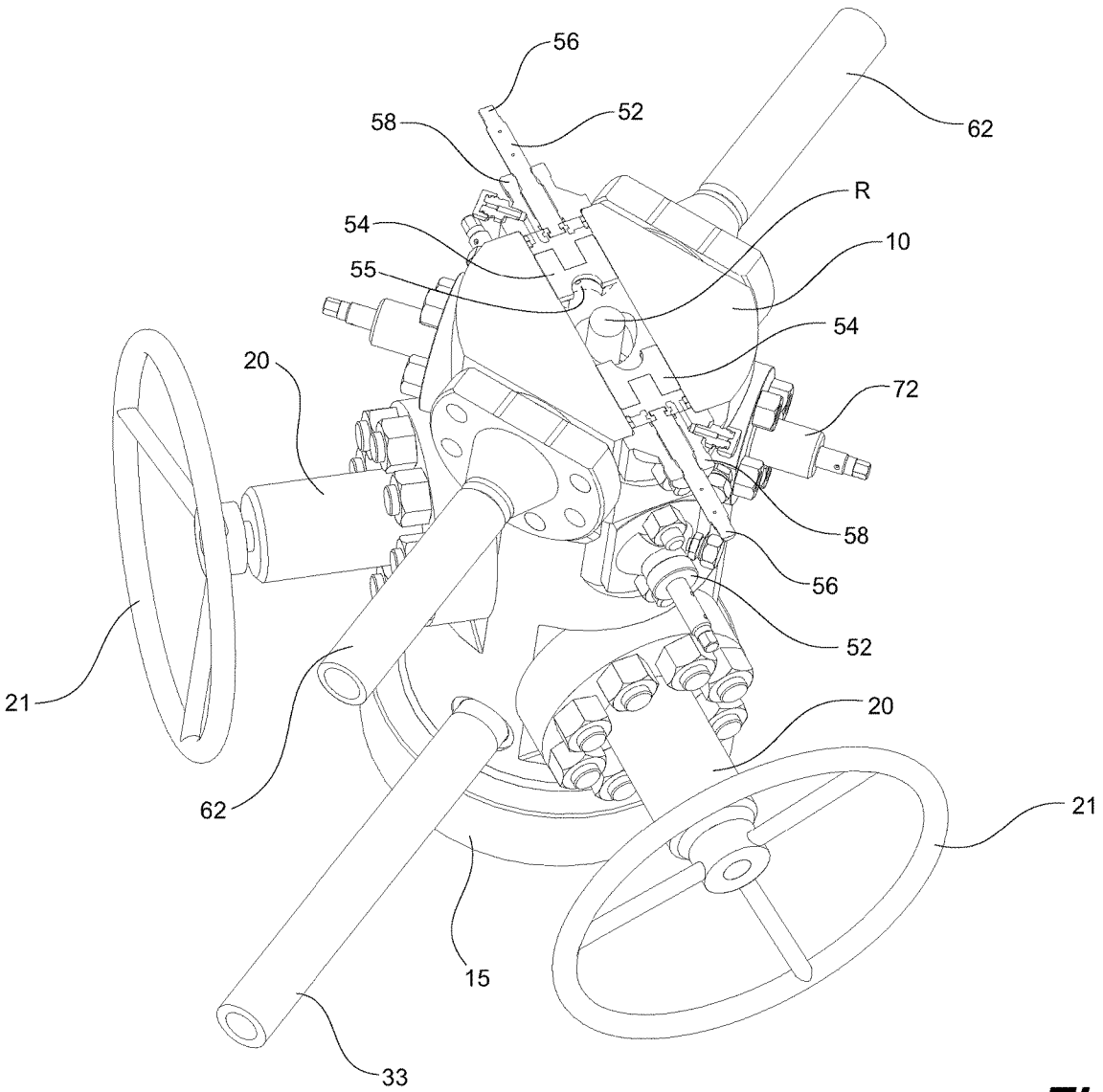
FIG. 5D is a cross-section perspective view of the multifunction blowout preventer of FIG. 4A, along line v-v, showing a sealing ram assembly.

As best shown in FIG. 5D, each pair of radial bores 50 is formed to receive a sealing ram assembly 52, comprising a pair of ram blocks 54 actuable to engage the pump rod R and a pair of ram rods 56 each extending from its respective ram block 54 through a ram housing 58 to an actuator (not shown). Ram housing 58 sealably retains ram block 54 and ram rod 56 to the housing 10, and ram rod 56 extends sealingly through its respective ram housing 58 and substantially laterally from exterior wall 11. Each ram housing 58 may be secured to housing 10, for example with a flanged connection.

The ram assembly 52 has a deactivated position, wherein ram blocks 54 are not engaged with the pump rod R, and an activated position, wherein ram blocks 54 are driven into radial sealing engagement with the pump rod R. Ram blocks 54 can be shaped and configured to create a fluid tight seal against the exterior surface of the pump rod R. For example, an inward face 55 of each ram block 54 has a semicircular channel, fit with annular, semi-circular seals, to ensure that a substantially fluid tight seal is created when the inward face 55 is urged against the exterior surface of the pump rod R. The ram blocks 54 seal against the pump rod R when the ram blocks 54 are driven inward in the activated position.

One or more actuators (not shown) can be used to shift the ram assemblies 52 between the deactivated position and the activated position. A variety of actuator mechanisms may be used to move the ram assemblies 52 between their activated and deactivated positions. Such mechanisms include, for example, manual, hydraulic, pneumatic, electric actuators, and any combination thereof. The ram housings 58, ram blocks 54 and ram rods 56 can be of conventional construction known in the art. If desired, additional pairs of radial bores 50 and ram assemblies 52 can be included in the BOP 8 to provide greater safety and redundancy.

As best shown in FIG. 5C, each pair of radial locking bores 70 is formed to receive a rod lock ram assembly 72, comprising a pair of locking ram blocks 74 and a pair of locking ram rods 76. Each locking ram rod 76 extends from its respective locking ram block 74 through a locking ram housing 78 to an actuator (not shown). Locking ram housing 78 sealably retains locking ram block 74 and locking ram rod 76 to housing 10, and locking ram rod 76 extends sealingly through its respective locking ram housing 78 and substantially laterally from exterior wall 11. Each locking ram housing 78 may be secured to the housing 10, for example with a flanged connection.

The rod lock ram assembly 72 has a deactivated position, wherein locking ram blocks 74 are not engaged with the pump rod R, and an activated position, wherein locking ram blocks 74 are driven into radial gripping engagement with the pump rod R to clamp the pump rod R to restrict rotational and/or axial movement of same. Ram lock blocks 74 can be shaped and configured to create a surface to matingly grip the exterior surface of the pump rod R. For example, an inward face 75 of each ram lock block 74 has a semicircular channel to matingly engage the pump R when the inward face 75 is urged against the exterior surface of the pump rod R. The ram lock blocks 74 securely grips the pump rod R when the ram lock blocks 74 are driven inward in the activated position.

While the depicted embodiment shows the sealing ram assemblies 52 and rod lock ram assemblies 72 as separate assemblies, it is possible to combine these. A person of skill in the art would understand that both separate and combined sealing ram and rod lock ram assemblies can be used in the multifunction BOP described herein.

Figures 6A, 6B:
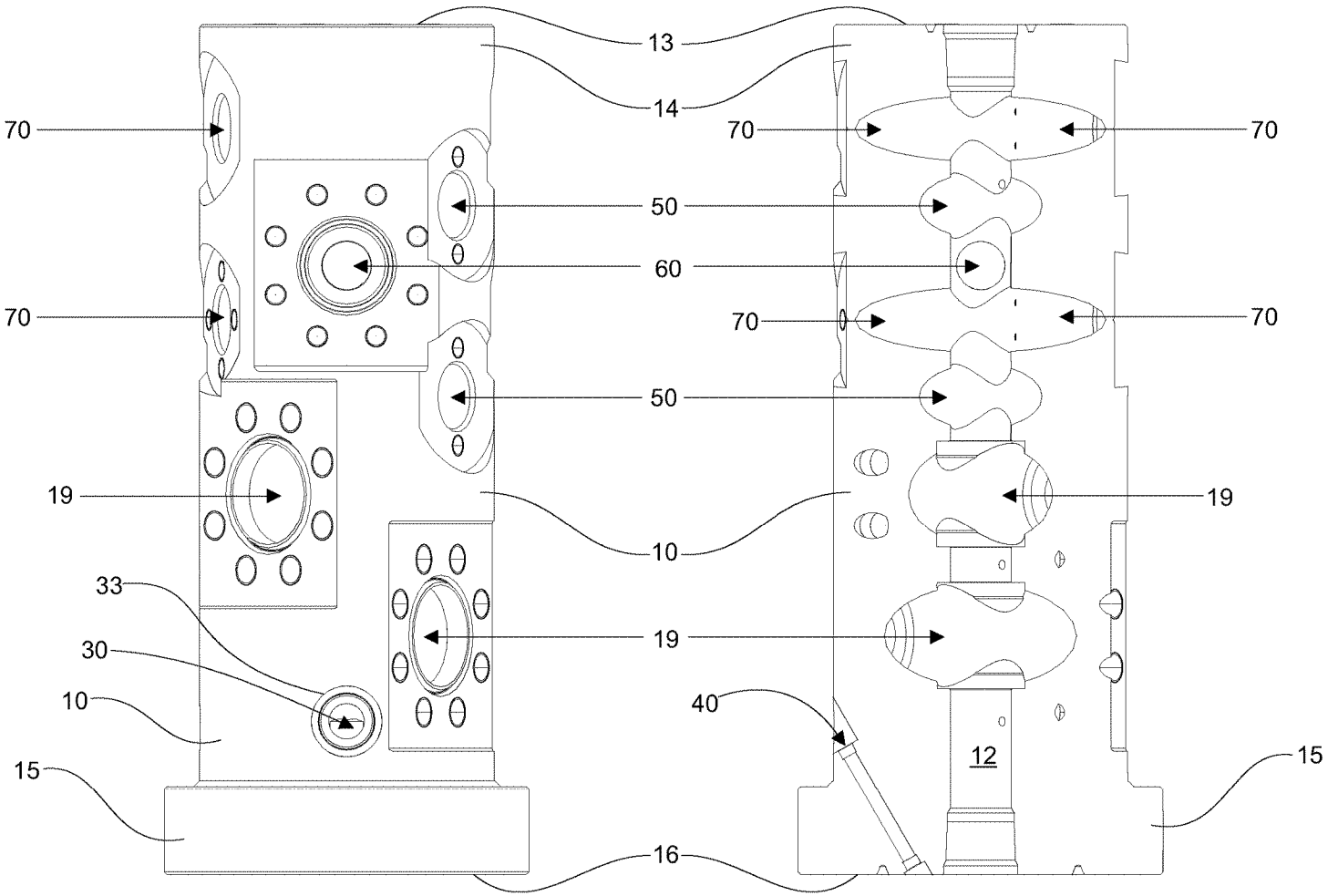
FIGS. 6A and 6B are a first side view and a cross-sectional view thereof, respectively, of a main housing of the multifunction blowout preventer according to one embodiment of the present disclosure.
Figures 7A, 7B:
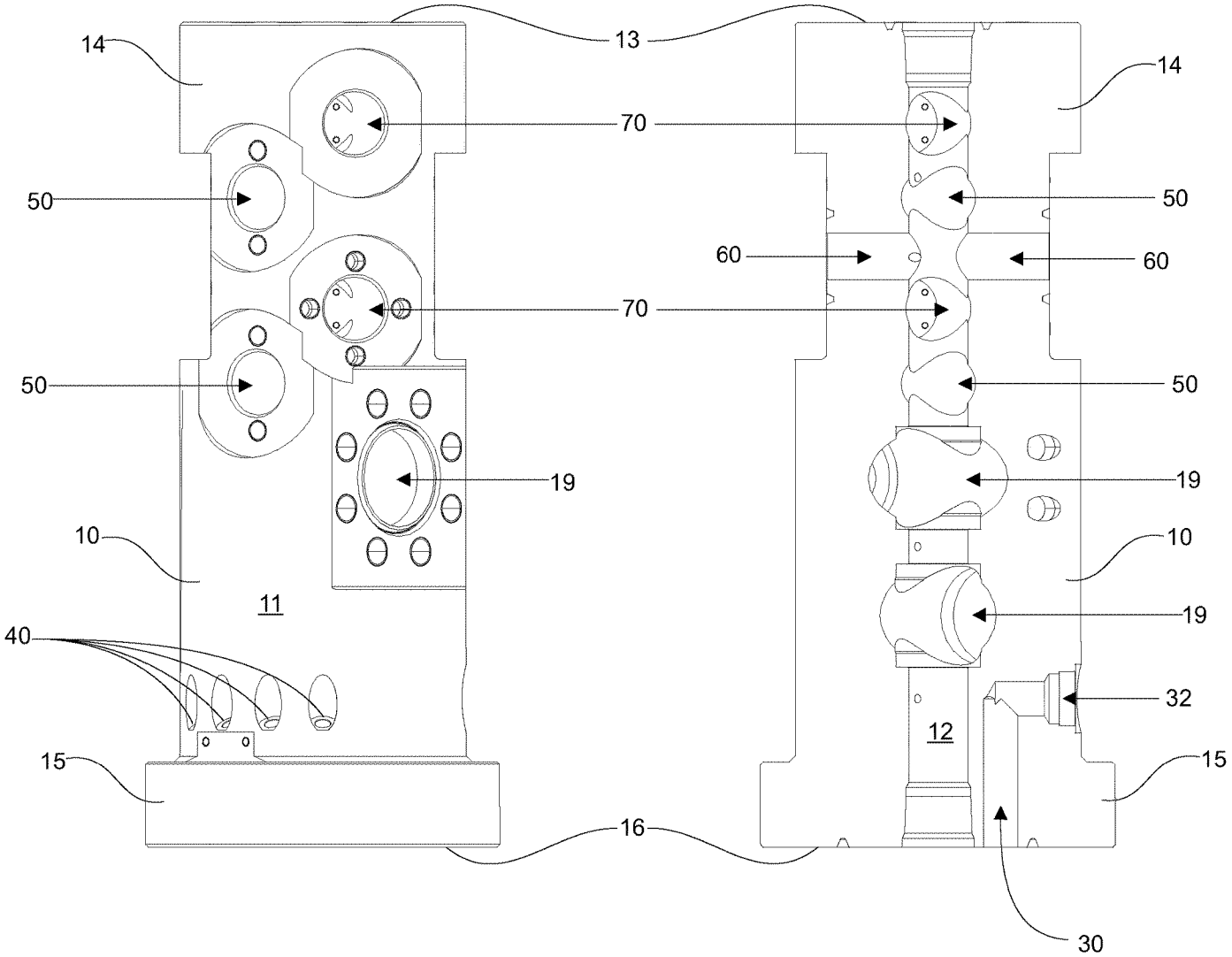
FIGS. 7A and 7B are a second side view and a cross-sectional view thereof, respectively, of the main housing of FIGS. 6A and 6B.

As best shown in FIGS. 3, 6A, and 6B, the one or more flow bores 60 are for removing fluids from the wellbore and each flow bore 60 may have a flow connection 62 connected thereto at its opening on exterior wall 11. Flow connections 62 are configured to connect to fluid lines for transporting wellbore fluids therethrough. If more than one flow bore 60 is used, the flow bores 60 can be of equal or different diameters, such that the housing 10 may engage with fluid lines of equal or different sizes. As in the depicted embodiment, more than one flow connection 62 can be provided such that one flow connection can be used for the regular removal of produced wellbore fluid and another flow connection is available for injection for well workovers, such as hot oil injection for the removal of paraffin wax.

In the depicted embodiment shown in the FIGS. 6A, 6B, 7A, and 7B, the positions of the gas lift bore 30, electrical ports 40, cavities 19, bores 50, locking bores 70, and flow bores 60 on exterior wall 11 are axially and/or radially offset or staggered about the periphery of housing 10 so that external parts of the gas lift tubing 33, connections to ports 40, gate valves 20, sealing ram assemblies 52, rod lock ram assemblies 72, and flow connections 62 do not interfere with one another, in order to help minimize the height of the multifunction BOP. In some embodiments, the gas lift bore 30, electrical ports 40, cavities 19, bores 50, locking bores 70, and flow bores 60 are radially offset from one another about the periphery of housing 10. In an alternative or additional embodiment, the gas lift bore 30, electrical ports 40, cavities 19, bores 50, locking bores 70, and flow bores 60 are axially staggered from one another along the length housing 10.

In use, when the reservoir pressure of a well is sufficient to produce well hydrocarbons to surface without assistance, the multifunction BOP 8 can be configured to have the gate valves 20 in the open position and the sealing ram assemblies 52 and rod lock ram assemblies 72 in the retracted position, while gas lift port 32 and electrical ports 40 are fluidly sealed, for example by using a threaded plug. Further, the bore 12 above the flow bores 60 is fluidly sealed such that the only flow path for fluids produced from the wellbore is through flow bores 60.

When the use of artificial lift methods is desired, the multifunction BOP 8 can be reconfigured without adding or replacing any wellhead stack components. When gas lift methods are to be used, gas lift port 32 can be connected to a gas injection apparatus, to allow gas to be injected through the gas lift bore 30 into the annulus between the wellbore tubing and casing to produce fluids up the wellbore tubing. Alternatively, fluid can be injected through the wellbore tubing to produce hydrocarbons up the annulus and through gas lift port 32 via gas lift bore 30.

When an ESP is to be used, wiring for the ESP can be run from an electrical junction box mounted on mounting bracket 42 through electrical ports 40 and downhole to the pump. Gas lift port 32 can be opened or sealed as needed.

When a reciprocating or rotating pump, such as a progressive cavity pump, is to be used, a pump, rod string, and pump rod can be inserted downhole through bore 12 to pump hydrocarbons to surface. Gas lift port 32 and electrical ports 40 can be fluidly sealed such that produced hydrocarbons flow out through flow bores 60. The sealing ram assemblies 52 function as a blowout preventer to fluidly seal the well to prevent wellbore fluids from escaping to surface, such as when downstream equipment is removed or disassembled for servicing, and to secure the rod string in the event of a pressure increase in the wellbore that could otherwise push the pump rod and the rest of the rod string out of the wellbore. Locking ram assemblies 72 function to further secure the rod string and prevent axial or rotational movement thereof in the event of a pressure increase or to support the rod string when the pump jack is disconnected.

The housing 10 can be manufactured by milling a single bar or by forging or casting of material, such as steel, or by other suitable manufacturing methods. Such manufacturing method further increases the structural soundness of the multifunction BOP compared to methods such as joining components with welds.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A multifunction blowout preventer comprising:

a housing formed as a single piece of material and having defined therein a longitudinal bore extending axially therethrough, the housing comprising:

a bottom connection for connecting to a wellbore and having a bottom face;

a gate valve section having defined therein at least one cavity in communication with the bore, each of the at least one cavity for receiving a gate valve for controlling fluid flow through the bore;

an integrated ram assembly/flow tee section having defined therein:

at least two pairs of opposing radial bores for receiving a sealing ram assembly;

at least two pairs of opposing radial locking bores for receiving a rod lock ram assembly; and one or more flow bores for removing fluid from and/or introducing fluid to the wellbore, wherein the at least two pairs of opposing radial bores, the at least two pairs of opposing radial locking bores, and the one or more flow bores extend radially outwardly from the bore and open to an exterior wall of the housing and are in communication with the bore, and the one or more flow bores are located axially in the housing between one or both of the two pairs of opposing radial bores and the two pairs of opposing radial locking bores that are closest to the bottom connection;

a combined gas lift/electrical ports section having defined therein:

one or more electrical ports extending between and opening to the exterior wall and the bottom face in an annulus between central wellbore tubing and casing; and a gas lift bore extending between and opening to a gas lift port on the exterior wall and the bottom face in the annulus; and a top connection for connecting to upper wellhead components.

2. The multifunction blowout preventer of claim 1, wherein the at least one cavity, the at least two pairs of opposing radial bores, the at least two pairs of opposing radial locking bores, and the one or more flow bores are radially offset from one another about the periphery of the housing and/or axially staggered from one another along the length of the housing.

3. The multifunction blowout preventer of any one of claim 1, further comprising one or more of:

a gate valve positioned in at least one of the at least one cavity;

a sealing ram assembly positioned in at least one of the at least two pairs of opposing radial bores;

a rod lock ram assembly positioned in at least one of the at least two pairs of opposing radial locking bores; and a flow connection connected to at least one of the one or more flow bores.

4. The multifunction blowout preventer of claim 3, wherein the sealing ram assembly comprises a pair of ram blocks, a pair of ram rods, and a pair of ram housings, wherein each of the ram rods extends from one of the pair of ram blocks through one of the pair of ram housings;

and wherein the rod lock ram assembly comprises a pair of locking ram blocks, a pair of locking ram rods, and a pair of locking ram housings, wherein each of the locking ram rods extends from one of the pair of locking ram blocks through one of the pair of locking ram housings.

5. The multifunction blowout preventer of claim 1, further comprising a gas lift tubing connected to and extending outwardly from the gas lift port.

6. The multifunction blowout preventer of claim 1, further comprising a mounting bracket on the housing.

7. The multifunction blowout preventer of any one of claim 1, wherein the gate valve section has two or more cavities defined therein.

8. A multifunction blowout preventer comprising:

a housing formed as a single piece of material and having defined therein a longitudinal bore extending axially therethrough, the housing comprising:

a bottom connection for connecting to a wellbore;

a combined gas lift/electrical ports section having defined therein:

a gas lift bore extending between and opening to a gas lift port on an exterior wall of the housing and the face of the bottom connection in an annulus between central wellbore tubing and casing; and one or more electrical ports extending between and opening to the exterior wall and the face in the annulus;

a gate valve section having defined therein at least one cavity in communication with the bore, each of the at least one cavity for receiving a gate valve for controlling fluid flow through the bore;

an integrated rain assembly/flow tee section having defined there:

at least one pair of opposing radial bores for receiving a sealing ram assembly;

at least one pair of opposing radial locking bores for receiving a rod lock ram assembly; and one or more flow bores for removing fluid from the wellbore and/or introducing fluid to the wellbore, wherein the at least one pair of opposing radial bores, the at least one pair of opposing radial locking bores, and the one or more flow bores extend radially outwardly from the bore and open to the exterior wall and are in communication with the bore; and a top connection for connecting to upper wellhead components.

9. The multifunction blowout preventer of claim 8, wherein the gas lift port, the one or more electrical ports, the at least one cavity, the at least one pair of opposing radial bores, the at least one pair of opposing radial locking bores, and the one or more flow bores are radially offset from one another about the periphery of the housing and/or axially staggered from one another along the length of the housing.

10. The multifunction blowout preventer of claim 8, further comprising one or more of:

a gas lift tubing connected to and extending outwardly from the gas lift port;

a mounting bracket on the housing;

a gate valve positioned in at least one of the at least one cavity;

a sealing ram assembly positioned in at least one of the at least one pair of opposing radial bores;

a rod lock ram assembly positioned in at least one of the at least one pair of opposing radial locking bores; and a flow connection connected to at least one of the one or more flow bores.

11. The multifunction blowout preventer of claim 10, wherein the sealing ram assembly comprises a pair of ram blocks, a pair of ram rods, and a pair of ram housings, wherein each of the ram rods extends from one of the pair of ram blocks through one of the pair of ram housings; and wherein the rod lock ram assembly comprises a pair of locking ram blocks, a pair of locking ram rods, and a pair of locking ram housings, wherein each of the locking ram rods extends from one of the pair of locking ram blocks through one of the pair of locking ram housings.

12. The multifunction blowout preventer of any one of claim 8, wherein the gate valve section has two or more cavities defined therein.

13. The multifunction blowout preventer of any one of claim 8, wherein an integrated ram assembly/flow tee section has two or more pairs of opposing radial bores and two or more pairs of opposing radial locking bores defined therein, and wherein the one or more flow bores are located axially in the housing between one or both of the two pairs of opposing radial bores and the two pairs of opposing radial locking bores that are closest to the bottom connection.

* * * * *